United States Patent [19]

Blattler

[11] 4,212,186

[45] Jul. 15, 1980

[54] PIPE EXPANDER

[76] Inventor: Joseph F. Blattler, Suite 302, 10405 Saskatchewan Dr., Edmonton, Alberta, Canada

[21] Appl. No.: 954,659

[22] Filed: Oct. 25, 1978

[51] Int. Cl.[2] ..... B21D 41/02

[52] U.S. Cl. ..... 72/393; 72/453.07

[58] Field of Search ..... 72/392, 393, 453.07; 92/151; 269/48.1

[56] References Cited

U.S. PATENT DOCUMENTS

| | | | |
|---|---|---|---|
| 2,461,565 | 2/1949 | Morrill | 72/393 |
| 2,943,667 | 7/1960 | Ewing et al. | 72/393 |
| 3,752,040 | 8/1973 | Pawloski et al. | 92/151 |
| 3,783,620 | 1/1974 | Moe | 92/151 |
| 4,064,730 | 12/1977 | Gerretz | 72/393 |

*Primary Examiner*—Lowell A. Larson

*Attorney, Agent, or Firm*—Burns, Doane, Swecker & Mathis

[57] ABSTRACT

A tube expander of the type having a series of die members suitable for engaging the inside of a tube to expand it and which are guided for radial movement by a thrust plate, and which are caused to move radially by a mandrel movable axially within the thrust plate by a piston moving within an hydraulic cylinder, the mandrel having a circumferentially spaced series of slideways sloping outwardly from an inner end of the mandrel, with each slideway cooperating with a similarly sloping inner surface of one of the die members; wherein the slideways are at least partially recessed within the mandrel so that the force-transmitting area of the mandrel is not limited by the area circumscribed by the innermost ends of the slideways. In addition, the mandrel and piston rod and connecting parts therebetween all have a transverse area which is larger at all points than the area circumscribed by the innermost ends of the slideways. By this means, larger forces can be applied by the mandrel than with prior art tube expanders.

6 Claims, 2 Drawing Figures

PIPE EXPANDER

The present invention relates to tube expanders for expanding the ends of large diameter tubes or pipes prior to welding. The expander is particularly useful for tubes of about 28 inches to 48 inches (or 71 cm to 122 cm) diameter, having a wall thickness of up to ¾ inch (1.9 cm), of the type used for gas pipe lines.

Apparatus for expanding tubes or pipes is known of the kind having a series of die members suitable for engaging the inside of a tube to expand this, the die members being guided for radial movement by a thrust plate and being movable radially by a mandrel which slides axially within the thrust plate and which has a circumferentially spaced series of slideways which slope outwardly from an inner end portion of the mandrel to its outer end, each slideway cooperating with a similarly sloping inner surface of one of the die members. The mandrel is movable axially by a piston connected via a piston rod to the inner end of the mandrel, the piston being movable in a hydraulic cylinder. Apparatus of this kind will be referred as "apparatus of the type described." Apparatus of this kind is shown for example in U.S. Pat. No. 2,943,667 to Ewing, and in Canadian Pat. No. 581,028 to Ewart.

In these prior art expanders, the slideways have been formed as flats on the outside of a generally conical mandrel. The force which can be applied by such a machine is limited by various factors including the diameter of the mandrel at its smallest end, which is the area of the mandrel circumscribed by the inner ends of the slideways. The force is also of course limited by other features including the diameter of the piston rod and connecting parts between the piston rod and mandrel.

The present invention provides an expander of the type described but which can apply much larger expansion forces than previous expanders of otherwise similar type.

In accordance with the present invention, in an expander of the type described, the slideways are at least partly recessed within the mandrel, and those portions of the madrel, piston rod, and connecting parts therebetween which are subjected to the full tension applied by the piston rod during tube expansion all have a minimum transverse area which is larger than the area circumscribed by the inner most ends of the slideways, so that the force which can be exerted by the mandrel is not limited by this circumscribed area.

Another important feature of the expander of this invention is that the piston rod carries two pistons each arranged in one of two tandem, axially aligned hydraulic cylinders.

The invention will be now described in more detail with reference to the accompanying drawings, in which.

Figure 1:
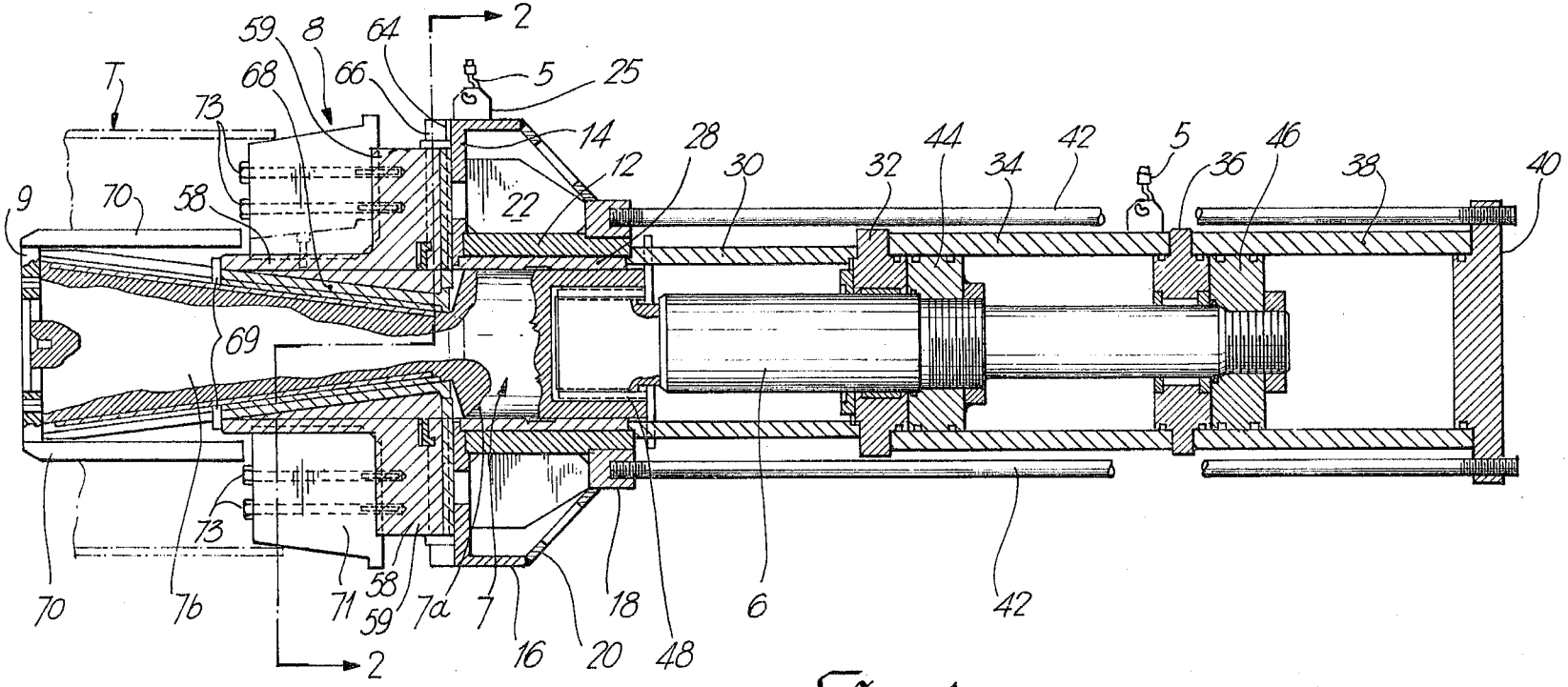
FIG. 1 shows a longitudinal section through the whole expander.

The expander comprises basically a static structure, which as shown in FIG. 1 can be supported by two hooks 5 for use in the field with a convenient supporting beam, this static structure providing a housing for the axially movable piston rod 6 and mandrel 7, and also supporting the die members indicated at 8.

The static structure comprises firstly a strong supporting sleeve 12, of cylindrical form, to the front end of which is welded an annular thrust plate 14. In order that the high forces developed in this machine can be resisted without undue distortion, a reinforcing structure is provided including a annular bracing ring 16 welded to the outer rim of the thrust plate 14 and surrounding the sleeve 12, a reinforcing ring 18 which surrounds the rear end of sleeve 12, and a series of plates 20 which are welded between the rear end of ring 16 and the front end of ring 18 to provide a generally conical bracing member between these parts. Also, a series of eight flat plates 22, orientated radially, are welded within the space formed by members 12, 14, 16, 18 and 20, to further brace these parts. A lifting lug 25 engagable by hook 5 is welded to the upper part of ring 16.

Within the sleeve 12 there is fitted a liner 28, which is held in place by a spacer 30 which is in turn held against the liner and the sleeve 12 by a hydraulic cylinder assembly including an inner end plate 32, a first cylinder 34, a divider plate 36, a second hydraulic cylinder 38, and an outer end plate 40, all of these parts being held in compression by tension rods 42 which connect the end plate 40 to the reinforcing ring 18. The hydraulic cylinders house first and second pistons 44 and 46, mounted on stepped portions of the piston rod 6 which has a screw connection at its front end to the mandrel 7. This mandrel has a cylindrical rear (inner) end portion *7a* slidable within liner 28, and is connected to the piston rod by a internally and externally threaded collar 48 which forms a weak link in the structure so that excessive forces between the mandrel and the piston rod only cause damage to this weak link and not to other parts.

The main portion *7b* of the mandrel has a series of eight circumferentially spaced flat slideways which slope outwardly from the inner end portion *7a* of the mandrel to the outer, front end of the mandrel. The cross-sectional form of the mandrel near to its inner end is shown in the top portion of FIG. 2, where it will be seen that the slideway surfaces 52 are recessed well within the material of the mandrel which has an outer surface indicated at *7c*. In fact the amount by which the slideway surfaces are recessed at this point is roughly equivalent to the radial distance of the slideways from the centre of the mandrel and this provides an area of material, outside of the area of the mandrel circumscribed by the inner ends of the slideways, which is roughly equivalent to said circumscribed area. In other words, the area of the mandrel at this point, and the amount of force which it can transmit, is roughly doubled as compared to a simple conical mandrel in which the slideways are not recessed. The recessing of the slideways of course decreases towards the front end of the mandrel and reaches a small constant amount about half way along the length of the slideways, as shown in the lower part of FIG. 2, after which the outer diameter of the mandrel expands to accommodate the sloping slideways.

The connecting parts between the mandrel and the piston rod, and the piston rod itself with the exception of the weak link element 48, all have areas which are relatively large compared to the circumscribed area at the base of the inner ends of the slideways. Specifically, those parts subjected to the full tension of the piston rod, including the piston rod itself, the annular area of the mandrel which surrounds the inner end of the piston rod, and the mandrel at the inner ends of the slideways, have areas roughly twice the said circumscribed area of the mandrel. Also, the base of the recess in the mandrel which receives the end of the piston rod is spaced from the inner ends of the slideways so that there is adequate strength of material in the portion of the mandrel connecting the piston rod and end portion *7b*.

It may be noted that although the "weak link" insert 48 is of relatively small area this is not subjected to tension by the piston rod, but rather to shear. The function of the insert 48 is primarily to protect the thread inside the expansion mandrel 7, which is considerably stronger in shear than the threaded connecting portion of the piston rod in tension. The weak link bushing 48 is of somewhat lesser strength material than the expander mandrel or the piston rod and is designed slightly weaker in shear on the piston rod thread than the piston rod threaded portion cross-section could hold in tension. Therefore, this connection would fail in the following order:

(a) bushing thread shears on the inside diameter;

(b) threaded portion on the piston rod fails in tension or thread on the piston rod fails in shear;

(c) thread of outside diameter of bushing 48 fails in shear;

(d) thread on inside diameter of mandrel fails in shear;

(e) threaded portion of mandrel fails in tension.

Figure 2:
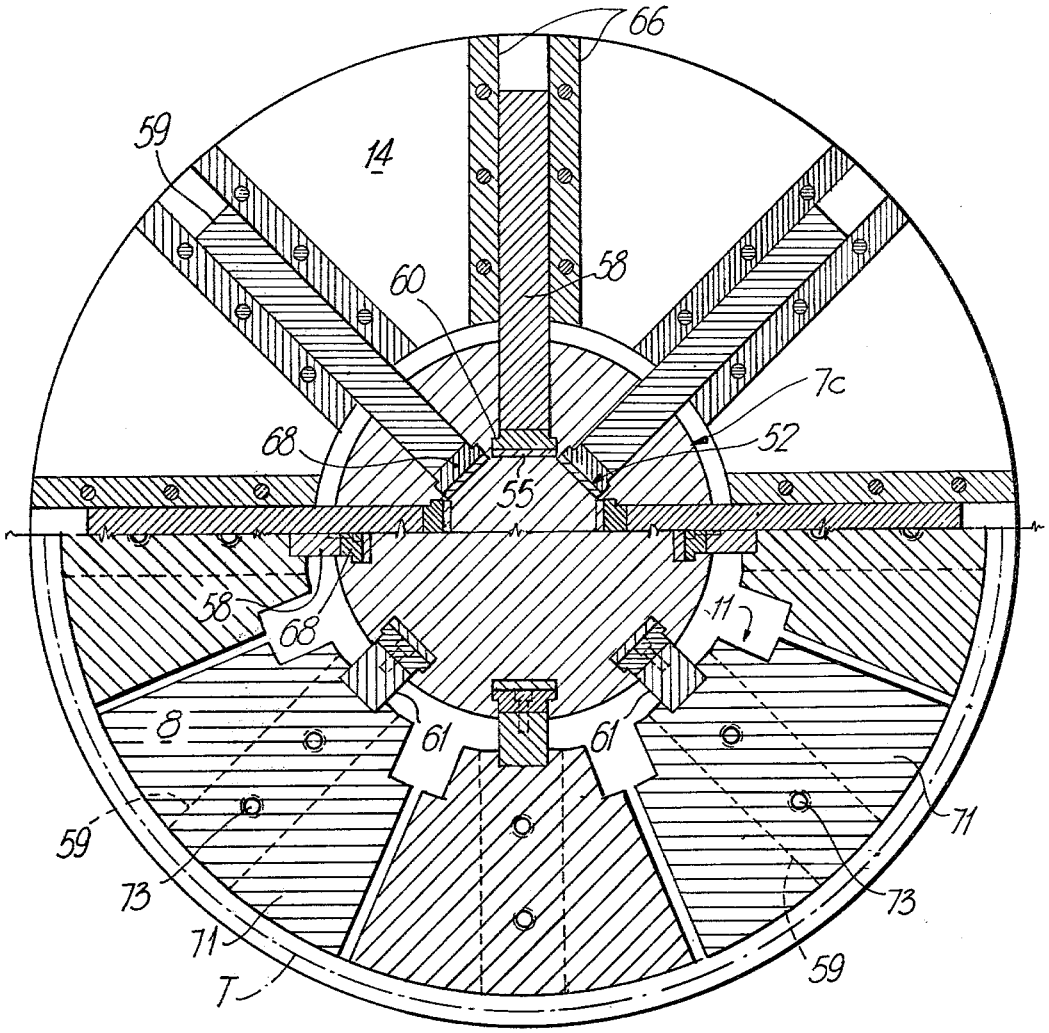
FIG. 2 shows a section line on line 2—2 of the FIG. 1.

Referring to the details of the slideways shown in FIG. 2, the base of each slideway is provided with an inset 55 of hard tool steel, held firmly within the slideway by screws. Within each slideway is positioned a die show 58, which is an L-shaped element having a radial portion 59 slidable along the thrust plate 14, and having a cam surface 61 extending parallel to the slideway and having lateral ribs 60 which engage in undercut portions of the slideway. The radial portions of the shoes are slidable within shalow, radial grooves within the thrust plate, and are further guided and retained in place by keeper members 66 provided along each side of the grooves, and which interlock with ribs of the soes to hold these against the thrust plate. The portions of the shoes slidable within the grooves of the thrust plate, and also adjacent the slideway surfaces, are lined with an aluminum bronze pad 68. The forward ends of the die shoes are provided with wiper pads 69 for removing dirt from the slideways, and to further protect the slideways from dirt the front end of the mandrel carries a surrounding guard consisting of a circular plate 9 and rearwardly extending fingers 70 which are received in apertures 11 between the dies (FIG. 2).

Each of the die shoes 58 has removably attached thereto a die segment 71, the combination of die segment and shoe providing a "die member." The dies are attached by bolts 73 to the radial portions 59 of the shoes. The dies are chosen to suit the diameter of pipe to be expanded, and are such that when the mandrel is in the forward position as shown in FIG. 1, and with the die members retracted, a tube T to be expanded can be placed over the smaller ends of the segments 71. With the tube so positioned, admission of hydraulic fluid to the cylinders 34 and 38 causes strong forces to be exerted on the piston rod 6, drawing the mandrel rearwardly and forcing the die shoes and dies outwardly to expand the tube. In the preferred embodiment of machine, the hydraulic cylinders are suitable for producing a total axial force of about 1000 tons, and this force acting on the die shoes via the mandrel slideways produces a radial force of between 3000 and 4000 tons. This is sufficient to provide permanent expansion of the tube end, which, when repeated around the tube to give a reasonably uniform expansion, is sufficient to allow the expanded tube to be placed over another, unexpected tube end, for welding.

The in-line arrangement of hydraulic cylinders allows extreme forces to be produced without undue sealing problems with the pistons, and without causing any bending movements on the structure such as might be caused if side-by-side cylinders were to be used. It is to be noted that the whole in-line arrangement, and the hollow reinforcing structure behind the thrust plate 14 which connects this to the rear end of sleeve 12, enables large forces to be transmitted without causing undue bending of any parts.

I claim:

1. In a tube expander of the kind having a series of die members suitable for engaging the inside of a tube to expand this, said die members being guided for radial movement by a thrust plate and being caused to move by a mandrel movable axially within the thrust plate and having a circumferentially spaced series of slideways which slope outwardly from an inner end portion of the mandrel to an outer end thereof, each slideway cooperating with a similarly sloping inner surface of one of said die members, said mandrel being movable axially by a piston connected via a piston rod to the inner end thereof and movable in a hydraulic cylinder; the improvement wherein said slideways are at least partly recessed within said mandrel, and those portions of said mandrel, piston rod, and connecting parts therebetween which are subjected to the full tension applied by the piston rod during tube expansion all have a minimum transverse area which is larger than the area circumscribed by the innermost ends of said slideways, whereby the force which can be exerted by the mandrel is not limited by said circumscribed area.

2. A tube expander according to claim 1, wherein said piston rod carries two pistons each arranged in one of two tandem, axially aligned hydraulic cylinders.

3. A tube expander according to claim 1, wherein said piston rod engages by screw thread means within a recess in a connecting portion of said mandrel, the base of said recess being spaced from the inner ends of said slideways.

4. A tube expander according to claim 1, wherein said mandrel, piston rod, and those connecting parts therebetween which are subjected to the full tension applied by the piston rod during tube expansion all have a minimum area which is at least of the order of twice the said circumscribed area of the mandrel.

5. A tube expander according to claim 1, wherein said die members are provided with wiper means for removing dirt from said slideways.

6. A tube expander according to claim 1, wherein said thrust plate is welded around an end of a sleeve within which said mandrel is slidable, and wherein a hollow reinforcing structure is provided connecting outer portions of the thrust plate to the end of said sleeve remote from the thrust plate.

* * * * *